US008162632B2

(12) United States Patent
Hunt et al.

(10) Patent No.: US 8,162,632 B2
(45) Date of Patent: Apr. 24, 2012

(54) FLUID PUMP

(75) Inventors: Devlin Hunt, Winthrop Harbor, IL (US); John Feuerstein, Racine, WI (US); Tony Urbanik, Kenosha, WI (US)

(73) Assignee: BRP US Inc., Sturtevant ( * ) Notice: Subject to any disclaimer, the term of this patent is extended or adjusted under 35 U.S.C. 154(b) by 1210 days.

(21) Appl. No.: 11/931,017

(22) Filed: Oct. 31, 2007

(65) Prior Publication Data

US 2009/0087330 A1 Apr. 2, 2009

Related U.S. Application Data

(60) Provisional application No. 60/976,178, filed on Sep. 28, 2007.

(51) Int. Cl.
*F04B 37/00* (2006.01)

(52) U.S. Cl. ..... 417/465; 91/493; 418/68

(58) Field of Classification Search ..... 417/462, 417/465; 91/491, 493; 418/68
See application file for complete search history.

(56) References Cited

U.S. PATENT DOCUMENTS

| | | | | |
|---|---|---|---|---|
| 1,442,195 | A | 1/1923 | Trane | |
| 2,510,903 | A | 6/1950 | Quiroz | |
| 3,338,168 | A * | 8/1967 | Davis | 137/565.28 |
| 4,043,711 | A | 8/1977 | Seino | |
| 4,166,438 | A * | 9/1979 | Gottschalk | 123/43 R |
| 4,553,506 | A | 11/1985 | Bekiaroglou | |
| 4,621,982 | A | 11/1986 | Schulz et al. | |
| 4,904,163 | A | 2/1990 | Tachi et al. | |
| 4,920,859 | A | 5/1990 | Smart et al. | |
| 5,190,447 | A | 3/1993 | Schneider | |
| 5,642,988 | A | 7/1997 | Zorn | |
| 6,537,040 | B2 | 3/2003 | Herrmann et al. | |
| 6,692,237 | B1 | 2/2004 | Komatsu et al. | |

FOREIGN PATENT DOCUMENTS

| | | | |
|---|---|---|---|
| DE | 19520321 | A1 | 12/1995 |
| FR | 2788567 | A1 | 7/2000 |
| GB | 642501 | | 9/1950 |
| JP | 58117368 | A | 7/1983 |
| JP | 60093106 | A | 5/1985 |
| JP | 01315677 | A | 12/1989 |
| JP | 11037044 | A | 2/1999 |

* cited by examiner

*Primary Examiner* — Charles Freay
*Assistant Examiner* — Patrick Hamo
(74) *Attorney, Agent, or Firm* — Osler, Hoskin & Harcourt LLP

(57) ABSTRACT

A pump is disclosed, having a pumping chamber in the rotor. The rotor is rotatable between first, second, third and fourth positions. When the rotor is in the first position, an inlet cam assembly displaces a piston to draw fluid into the pumping chamber via a first housing inlet. When the rotor is in the second position, an outlet cam assembly displaces the piston to expel fluid out of the pumping chamber via a first housing outlet. When the rotor is in the third position, the inlet cam lobe assembly displaces the piston to draw fluid into the pumping chamber via a second housing inlet. When the rotor is in the fourth position, the outlet cam assembly displaces the piston to expel fluid out of the pumping chamber via a second housing outlet. A method of pumping fluid is also disclosed.

13 Claims, 12 Drawing Sheets

FLUID PUMP

CROSS REFERENCE

The present application claims priority from U.S. Provisional Patent Application No. 60/976,178 filed Sep. 28, 2007, entitled FLUID PUMP, which is incorporated herein by reference.

FIELD OF THE INVENTION

The present invention relates to a method and apparatus for pumping fluids.

BACKGROUND OF THE INVENTION

Internal combustion engines have many moving parts, and a number of these parts slide against each other with very tight tolerances. As such, these parts require lubrication to allow them to slide against one another and prevent the parts from becoming damaged.

Lubrication of the pistons of the engine is particularly important. As the pistons reciprocate in the cylinders as many as several thousand times per minute, they slide against the cylinder walls. In addition, the connection between the piston and the control rod (known as the "wrist pin") is subjected to sliding friction as the angle between the piston and the control rod changes throughout the engine cycle. It is important to deliver adequate lubricant to these sites, to ensure proper functioning of the engine.

A lubricant pump is typically employed to provide a regular supply of lubricant to these and other parts of the engine. The pump supplies lubricant simultaneously to suitable locations within the engine so that the lubricant reaches the sites where lubrication is required. For example, in a two-stroke engine, lubricant may be supplied to the air intake system of each cylinder, at a point upstream from the reed valve. The air intake system of the engine carries the lubricant into the combustion chamber of the cylinder, where it provides lubrication between the piston and the cylinder wall. Lubricant may also be provided to nozzles that are oriented to spray the lubricant on the wrist pin of each piston. The pump would supply lubricant to each of these locations, to ensure that they remain lubricated.

However, prior art pumps have a number of drawbacks. Pumps typically include check valves to ensure that the lubricant is pumped in the intended direction, toward the surfaces that require lubrication, and to restrict the flow of lubricant in the opposite direction. These check valves are susceptible to sticking at cold temperatures, resulting in irregular or insufficient supply of lubricant. In addition, lubricant must be supplied to a number of areas at the same time, particularly in engines having several cylinders, each with a piston requiring lubrication. For example, if the engine has four cylinders, the pump must supply lubricant to eight separate locations: four pistons and four wrist pins. Pumping lubricant to eight places simultaneously reduces the quantity of lubricant that can be supplied to each location, and thereby reduces the effectiveness of the lubrication.

Therefore, there is a need for a way of providing lubrication to portions of an engine.

SUMMARY OF THE INVENTION

It is an object of the present invention to ameliorate at least some of the inconveniences present in the prior art.

It is also an object of the present invention to provide a pump without check valves that are susceptible to sticking at low temperatures.

It is also an object of the present invention to provide a pump that delivers lubricant sequentially to more than one location.

In one aspect, the invention provides a piston pump, comprising a housing. A rotor assembly is rotatably disposed in the housing. The rotor assembly comprises a rotor. A pumping chamber is disposed in the rotor. A piston is slidably disposed within the pumping chamber and movable between a first position and a second position therein. The housing comprises a first housing inlet and a second housing inlet selectively fluidly communicating with the pumping chamber. The housing comprises a first housing outlet and a second housing outlet selectively fluidly communicating with the pumping chamber. An inlet cam assembly is fixedly disposed in the housing. The inlet cam assembly has first and second inlet cam lobes operative to move the piston to the first position. An outlet cam assembly is fixedly disposed in the housing. The outlet cam assembly has first and second outlet cam lobes operative to move the piston to the second position. The rotor is rotatable sequentially between first, second, third and fourth positions relative to the housing. When the rotor is in the first position: the pumping chamber is in fluid communication with the first housing inlet and in fluid isolation from the second housing inlet and from the first and second housing outlets; and the first inlet cam lobe urges the piston toward the first position to draw fluid into the pumping chamber via the first housing inlet. When the rotor is in the second position: the pumping chamber is in fluid communication with the first housing outlet and in fluid isolation from the first and second housing inlets and from the second housing outlet; and the first outlet cam lobe urges the piston to the second position to expel fluid out of the pumping chamber via the first housing outlet. When the rotor is in the third position: the pumping chamber is in fluid communication with the second housing inlet and in fluid isolation from the first housing inlet and from the first and second housing outlets; and the second inlet cam lobe urges the piston toward the first position to draw fluid into the pumping chamber via the second housing inlet. When the rotor is in the fourth position: the pumping chamber is in fluid communication with the second housing outlet and in fluid isolation from the first housing outlet and the first and second housing inlets; and the second outlet cam lobe urges the piston to the second position to expel fluid out of the pumping chamber via the second housing outlet.

In a further aspect, the housing is generally symmetric about a central longitudinal axis of symmetry.

In a further aspect, the rotor is rotatable about the central longitudinal axis of symmetry.

In a further aspect, the inlet cam is concentric with the central longitudinal axis of symmetry.

In a further aspect, the outlet cam is concentric with the central longitudinal axis of symmetry.

In a further aspect, the housing further comprises a third housing inlet selectively fluidly communicating with the pumping chamber. The housing further comprises a third housing outlet selectively fluidly communicating with the pumping chamber. The inlet cam assembly further comprises a third inlet cam lobe. The outlet cam assembly further comprises a third outlet cam lobe. When the rotor is in the first, second third and fourth positions, the pumping chamber is in fluid isolation from the third housing inlet and the third housing outlet. The rotor is further rotatable between fifth and sixth positions relative to the housing. When the rotor is in the fifth position: the pumping chamber is in fluid communication with the third housing inlet and in fluid isolation from the first and second housing inlets and from the first, second and third housing outlets; and the third inlet cam lobe urges the piston toward the first position to draw fluid into the pumping chamber via the third housing inlet. When the rotor is in the sixth position: the pumping chamber is in fluid communication with the third housing outlet and in fluid isolation from the first, second and third housing inlets and from the first and second housing outlets; and the third outlet cam lobe urges the piston to the second position to expel fluid out of the pumping chamber via the third housing outlet.

In a further aspect, the pumping chamber is a first pumping chamber. The piston is a first piston. The chamber inlet is a first chamber inlet. The chamber outlet is a first chamber outlet. A second pumping chamber is disposed in the rotor. A second piston is slidably disposed within the second pumping chamber and movable between a first position and a second position therein. The housing further comprises a third housing inlet and a fourth housing inlet selectively fluidly communicating with the second pumping chamber. The housing further comprises a third housing outlet and a fourth housing outlet selectively fluidly communicating with the second pumping chamber. The rotor is further rotatable between fifth, sixth, seventh and eighth positions relative to the housing. When the rotor is in the fifth position: the second pumping chamber is in fluid communication with the third housing inlet and in fluid isolation from the fourth housing inlet and from the third and fourth housing outlets; and the first inlet cam lobe urges the second piston toward the first position to draw fluid into the second pumping chamber via the third housing inlet. When the rotor is in the sixth position: the second pumping chamber is in fluid communication with the third housing outlet and in fluid isolation from the third and fourth housing inlets and from the fourth housing outlet; and the first outlet cam lobe urges the second piston to the second position to expel fluid out of the second pumping chamber via the third housing outlet. When the rotor is in the seventh position: the second pumping chamber is in fluid communication with the fourth housing inlet and in fluid isolation from the third housing inlet and from the third and fourth housing outlets; and the second inlet cam lobe urges the second piston toward the first position to draw fluid into the second pumping chamber via the fourth housing inlet. When the rotor is in the eighth position: the second pumping chamber is in fluid communication with the fourth housing outlet and in fluid isolation from the third housing outlet and the third and fourth housing inlets; and the second outlet cam lobe urges the second piston to the second position to expel fluid out of the second pumping chamber via the fourth housing outlet.

In a further aspect, the third housing inlet is the first housing inlet. The fourth housing inlet is the second housing inlet.

In a further aspect, the fifth position is the first position. The sixth position is the second position. The seventh position is the third position. The eighth position is the fourth position.

In an additional aspect, the invention provides a method of distributing fluid via a pump. The pump has a housing. A rotor is rotatably disposed within the housing. The rotor has a pumping chamber disposed therein. A piston is slidably disposed within the pumping chamber. The housing has a first housing inlet and a second housing inlet selectively fluidly communicating with the pumping chamber. The housing has a first housing outlet and a second housing outlet selectively fluidly communicating with the pumping chamber. The method comprises: rotating the rotor to a first position providing: fluid communication between the pumping chamber and the first housing inlet; fluid isolation between the pumping chamber and the second housing inlet; fluid isolation between the pumping chamber and the first and second housing outlets; and actuation of the piston to draw fluid into the pumping chamber via the first housing inlet; rotating the rotor to a second position providing: fluid communication between the pumping chamber and the first housing outlet; fluid isolation between the pumping chamber and the second housing outlet; fluid isolation between the pumping chamber and the first and second housing inlets; and actuation of the piston to expel fluid out of the pumping chamber via the first housing outlet; rotating the rotor to a third position providing: fluid communication between the pumping chamber and the second housing inlet; fluid isolation between the pumping chamber and the first housing inlet; fluid isolation between the pumping chamber and the first and second housing outlets; and actuation of the piston to draw fluid into the pumping chamber via the second housing inlet; and rotating the rotor to a fourth position providing: fluid communication between the pumping chamber and the second housing outlet; fluid isolation between the pumping chamber and the first housing outlet; fluid isolation between the pumping chamber and the first and second housing inlets; and actuation of the piston to expel fluid out of the pumping chamber via the first housing outlet.

In a further aspect, the housing is generally symmetric about a central longitudinal axis of symmetry. Rotating the rotor comprises rotating the rotor about an axis coaxial with the central longitudinal axis of symmetry.

In a further aspect, the housing further comprises a third housing inlet selectively fluidly communicating with the pumping chamber and a third housing outlet selectively fluidly communicating with the pumping chamber. The inlet cam assembly further comprises a third inlet cam lobe. The outlet cam assembly further comprises a third outlet cam lobe. Rotating the rotor to any of the first, second, third and fourth positions further provides fluid isolation from the third housing inlet and the third housing outlet. The method further comprises: rotating the rotor to a fifth position providing: fluid communication between the pumping chamber and the third housing inlet; fluid isolation between the pumping chamber and the first and second housing inlets; fluid isolation between the pumping chamber and the first, second and third housing outlets; and actuation of the piston to draw fluid into the pumping chamber via the third housing inlet; and rotating the rotor to a sixth position providing: fluid communication between the pumping chamber and the third housing outlet; fluid isolation between the pumping chamber and the first and second housing outlet; fluid isolation between the pumping chamber and the first, second and third housing inlets; and actuation of the piston to expel fluid out of the pumping chamber via the third housing outlet.

In a further aspect, the pumping chamber is a first pumping chamber. The piston is a first piston. The chamber inlet is a first chamber inlet. The chamber outlet is a first chamber outlet. The rotor further comprises a second pumping chamber disposed therein. A second piston is slidably disposed within the second pumping chamber. The housing further comprises a third housing inlet and a fourth housing inlet selectively fluidly communicating with the second pumping chamber. The housing further comprises a third housing outlet and a fourth housing outlet selectively fluidly communicating with the second pumping chamber. The method further comprises: rotating the rotor to a fifth position providing: fluid communication between the second pumping chamber and the third housing inlet; fluid isolation between the second pumping chamber and the fourth housing inlet; fluid isolation between the second pumping chamber and the third and fourth housing outlets; and actuation of the second piston to draw fluid into the second pumping chamber via the third housing inlet; rotating the rotor to a sixth position providing: fluid communication between the second pumping chamber and the third housing outlet; fluid isolation between the second pumping chamber and the third and fourth housing inlets; fluid isolation between the second pumping chamber and the fourth housing outlet; and actuation of the second piston to expel fluid out of the second pumping chamber via the third housing outlet; rotating the rotor to a seventh position providing: fluid communication between the second pumping chamber and the fourth housing inlet; fluid isolation between the second pumping chamber and the third housing inlet; fluid isolation between the second pumping chamber and the third and fourth housing outlets; and actuation of the second piston to draw fluid into the second pumping chamber via the fourth housing inlet; and rotating the rotor to an eighth position providing: fluid communication between the second pumping chamber and the fourth housing outlet; fluid isolation between the second pumping chamber and the third housing outlet; fluid isolation between the second pumping chamber and the third and fourth housing inlets; and actuation of the second piston to expel fluid out of the second pumping chamber via the fourth housing outlet.

For the purposes of this application, the terms "radial", "axial" and "tangential" are defined with respect to the axis of rotation of the rotor. Thus, "radial" refers to a direction toward or away from the axis of rotation and perpendicular to the axis of rotation, "axial" refers to a direction along or parallel to the axis of rotation, and "tangential" refers to a direction perpendicular to the radial direction and not along or parallel to the axial direction.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 1:
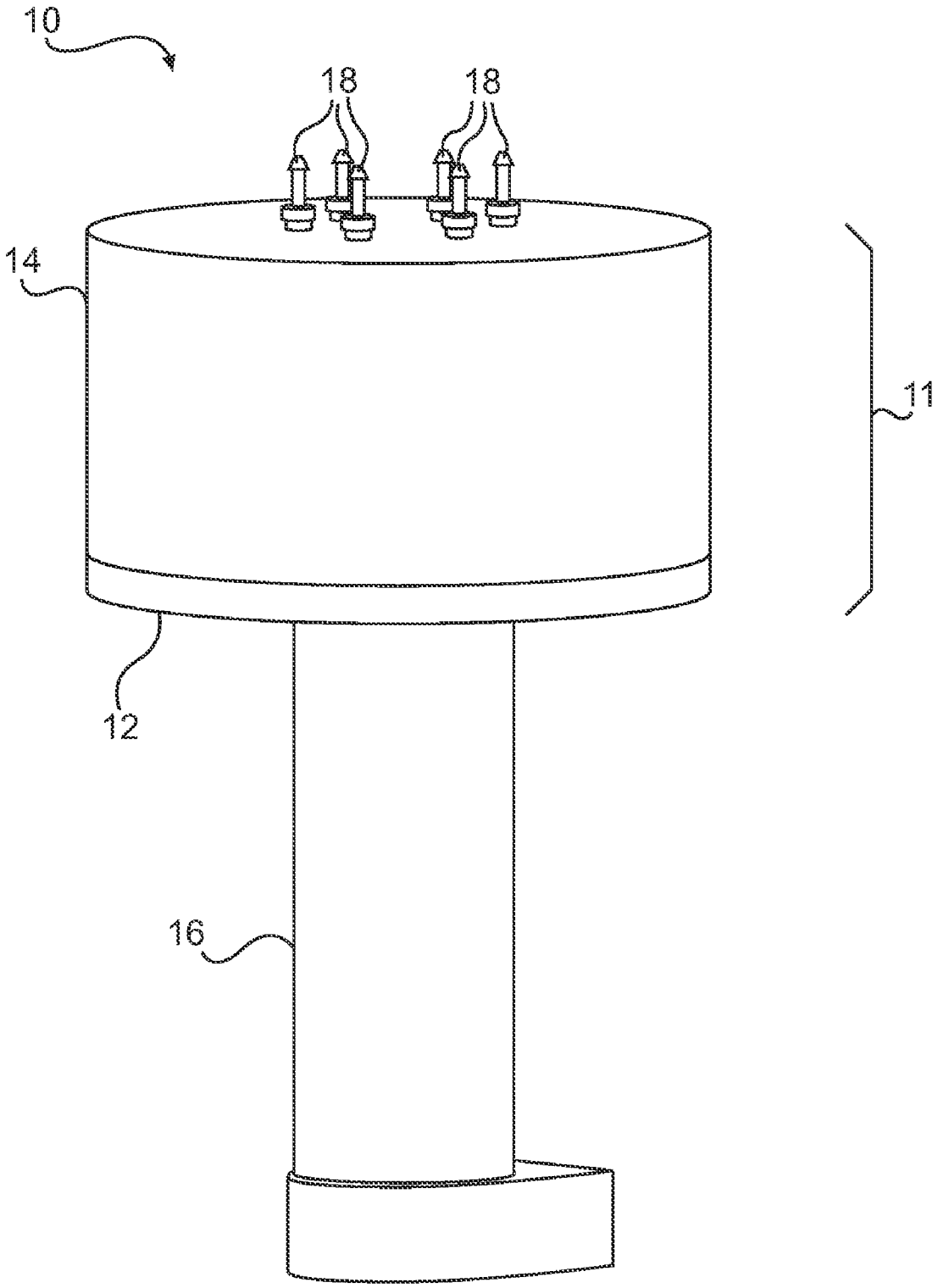
FIG. 1 is a perspective view of pump according to a first embodiment of the present invention.
Figure 2:
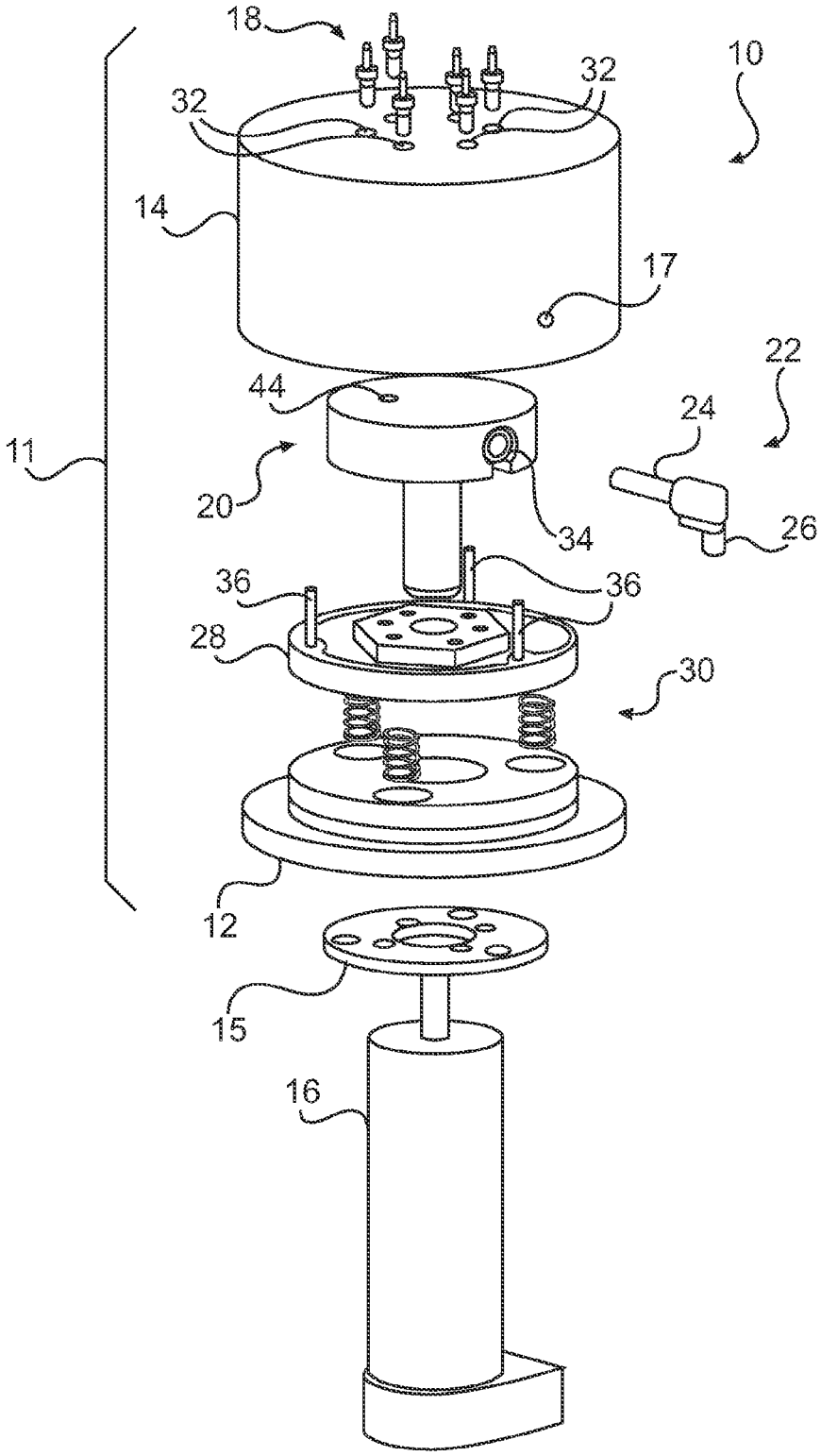
FIG. 2 is an exploded view of the pump of FIG. 1.

Referring generally to FIGS. 1 and 2, a pump 10 in accordance with a first embodiment of the present invention will be described.

Figure 4:
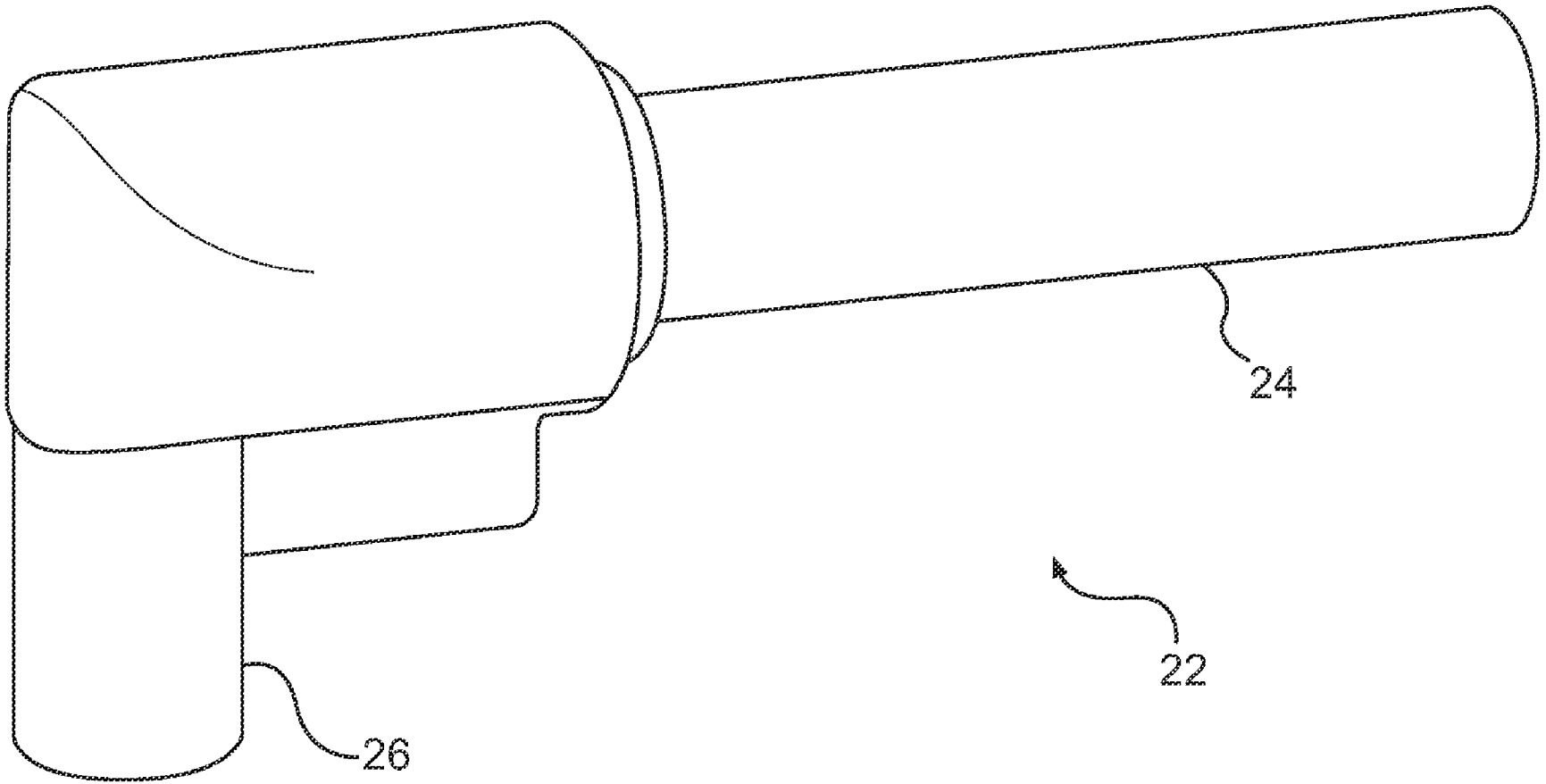
FIG. 4 is a perspective view of a piston for a pump according to a first embodiment of the present invention.

The pump 10 includes a housing 11 composed of a base plate 12 and a cover 14. The pump 10 is driven by an electric motor 16 via an adapter plate 15 (seen in FIG. 2) that is mounted to the base plate 12 via fasteners (not shown). The pump 10 may alternatively be driven by the crankshaft of an engine (not shown), or any other suitable source of power. Lubricant (not shown) enters the housing 11 via an aperture 17 (seen in FIG. 2) in the lateral wall of the cover 14 and fills the interior of the housing 11. Referring to FIG. 2, a rotor 20 is disposed inside the housing 11 such that it is free to rotate when driven by the motor 16. The rotor 20 houses a piston 22 consisting of a piston body 24 and a piston follower 26 (best seen in FIG. 4). The piston body 24 reciprocates within a bushing 34 to pump lubricant through the housing outlets 32 in the cover 14, as will be discussed below in further detail. Hose connectors 18 join the housing outlets 32 to hoses (not shown) to transmit the lubricant to a location where lubrication is desired. For example, the present embodiment with six housing outlets 32 could supply lubricant to up to six different locations, which can be suitable for lubricating a three-cylinder two-stroke engine (not shown). The lubricant output from three of the housing outlets 32 could be transmitted to a location upstream of each of the intake reed valves (not shown), and the lubricant output from the other three housing outlets 32 could be transmitted to the three wrist pins (not shown) of the respective pistons (not shown) of the engine. It is contemplated that the lubricant may instead be transmitted to any other location where lubrication is desired.

Referring to FIG. 2, an inlet plate 28 is positioned inside the housing 11, on the side of the rotor 20 opposite the housing outlets 32. When the pump 10 is assembled, the inlet plate 28 is biased against the rotor 20 by springs 30 positioned between the inlet plate 28 and the base plate 12. The springs 30 also bias the rotor 20 against the inside of the cover 14. The inlet plate 28 includes pins 36 that align with the apertures 38 (two of which can be seen in FIG. 6) in the cover 14, to preserve the relative orientation of the cover 14, base plate 12 and the inlet plate 28. The functioning of the inlet plate 28 and the cover 14, to respectively control lubricant flow into and out of the pumping chamber 40, will be described below in further detail.

Figure 3A:
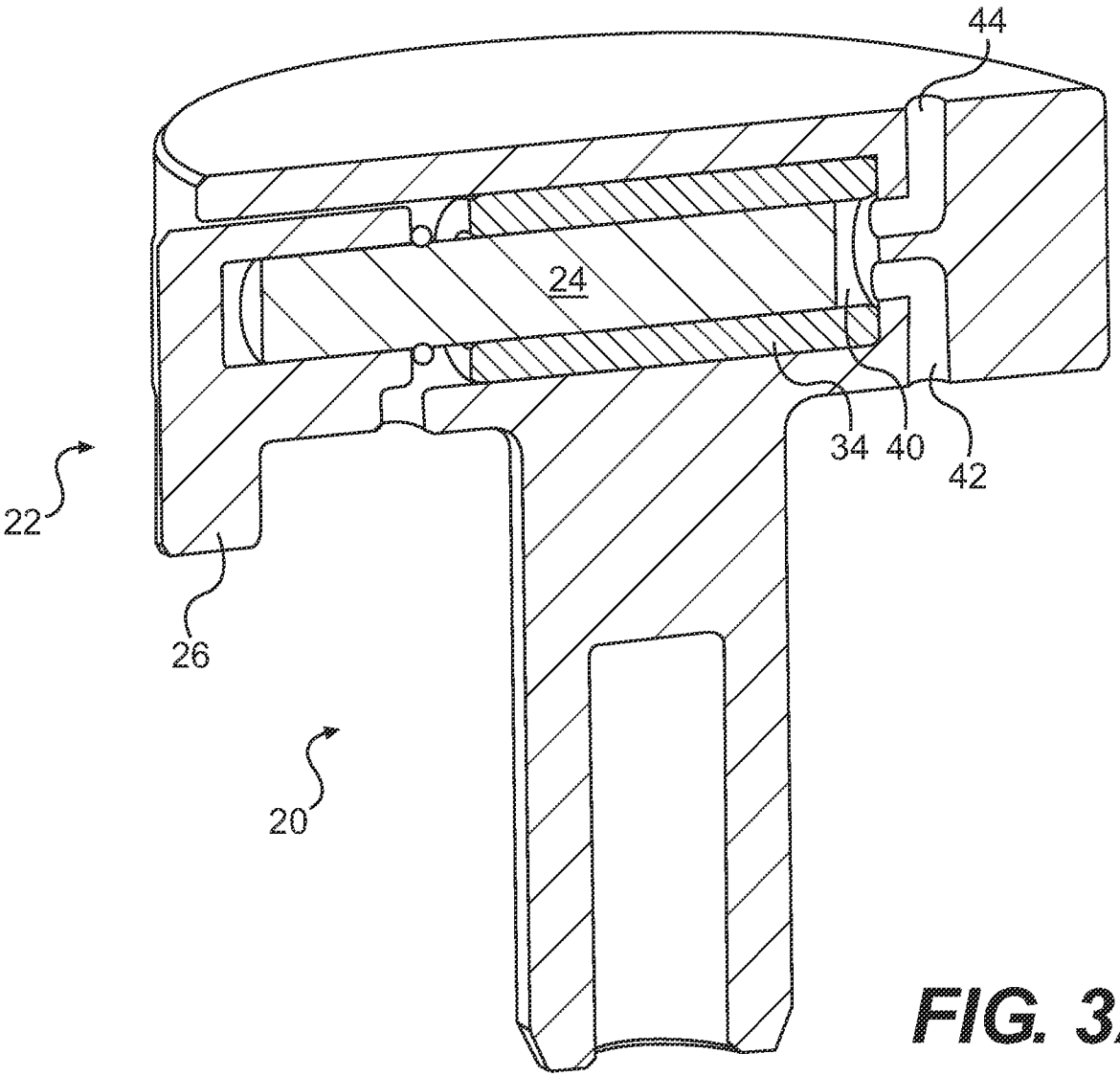
FIGS. 3A and 3B are cross-sectional perspective views of a rotor for the pump of FIG. 1, showing different positions of the piston.
Figure 3B:
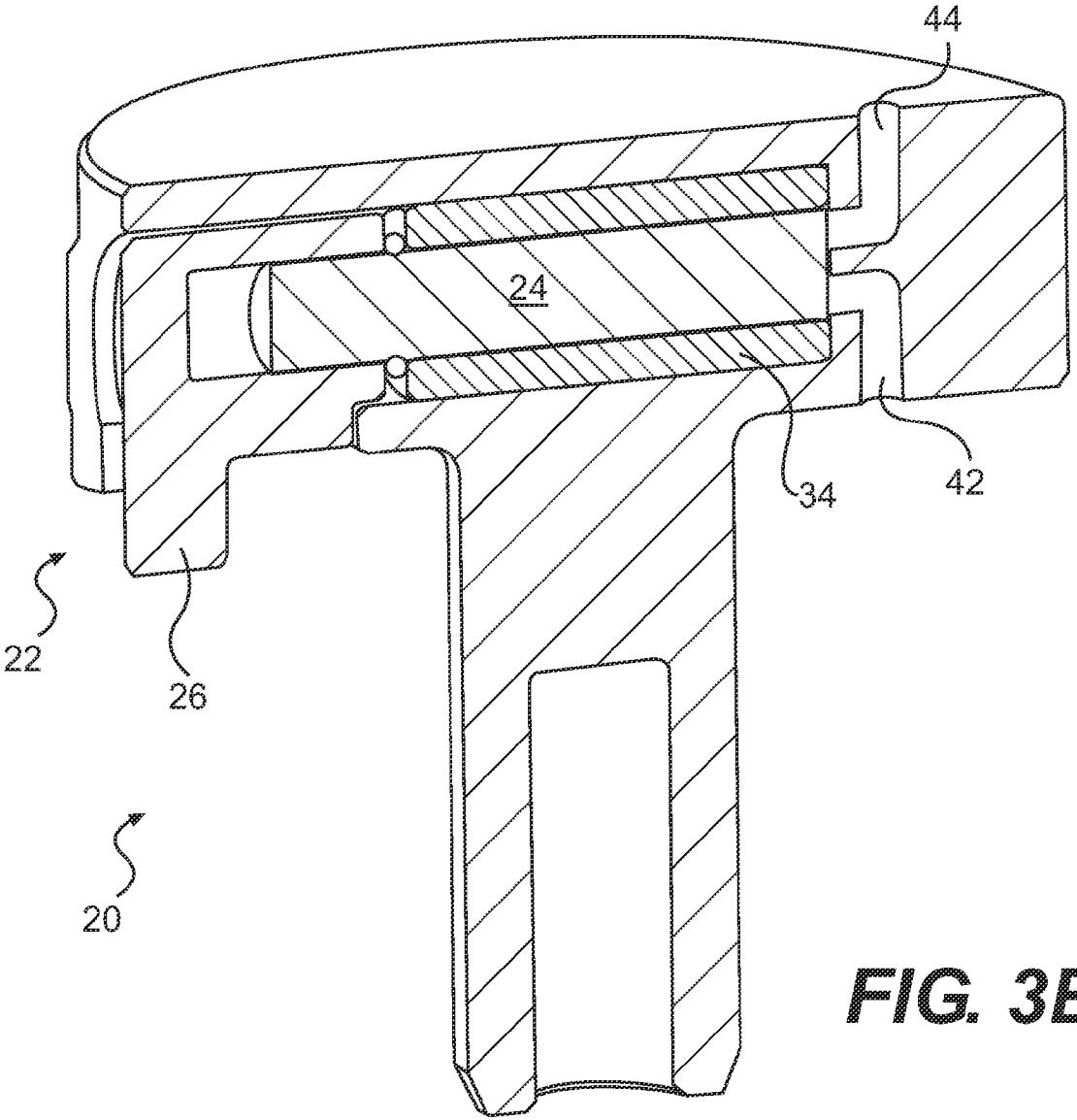

Referring now to FIGS. 3A and 3B, the operation of the rotor 20 will be described. As the motor 16 causes the rotor 20 to rotate within the housing 11, the piston body 24 of the piston 22 reciprocates within the bushing 34, as will be described in further detail below. The piston body 24 reciprocates between a first position (shown in FIG. 3A) and a second position (shown in FIG. 3B). The piston body 24 and the bushing 34 together define a pumping chamber 40 (best seen in FIG. 3A). The pumping chamber 40 is in selective fluid communication with the housing inlets 50 via a chamber inlet 42 and in selective fluid communication with the housing outlets 32 via a chamber outlet 44. As the rotor 20 rotates within the housing 11, the reciprocating movement of the piston body 24 draws lubricant into the pumping chamber 40 via the chamber inlet 42 when the piston body 24 moves toward the first position shown in FIG. 3A, and expels the lubricant out of the pumping chamber 40 through the chamber outlet 44 when the piston body 24 moves toward the second position shown in FIG. 3B, as will be described below in further detail.

Figure 5:
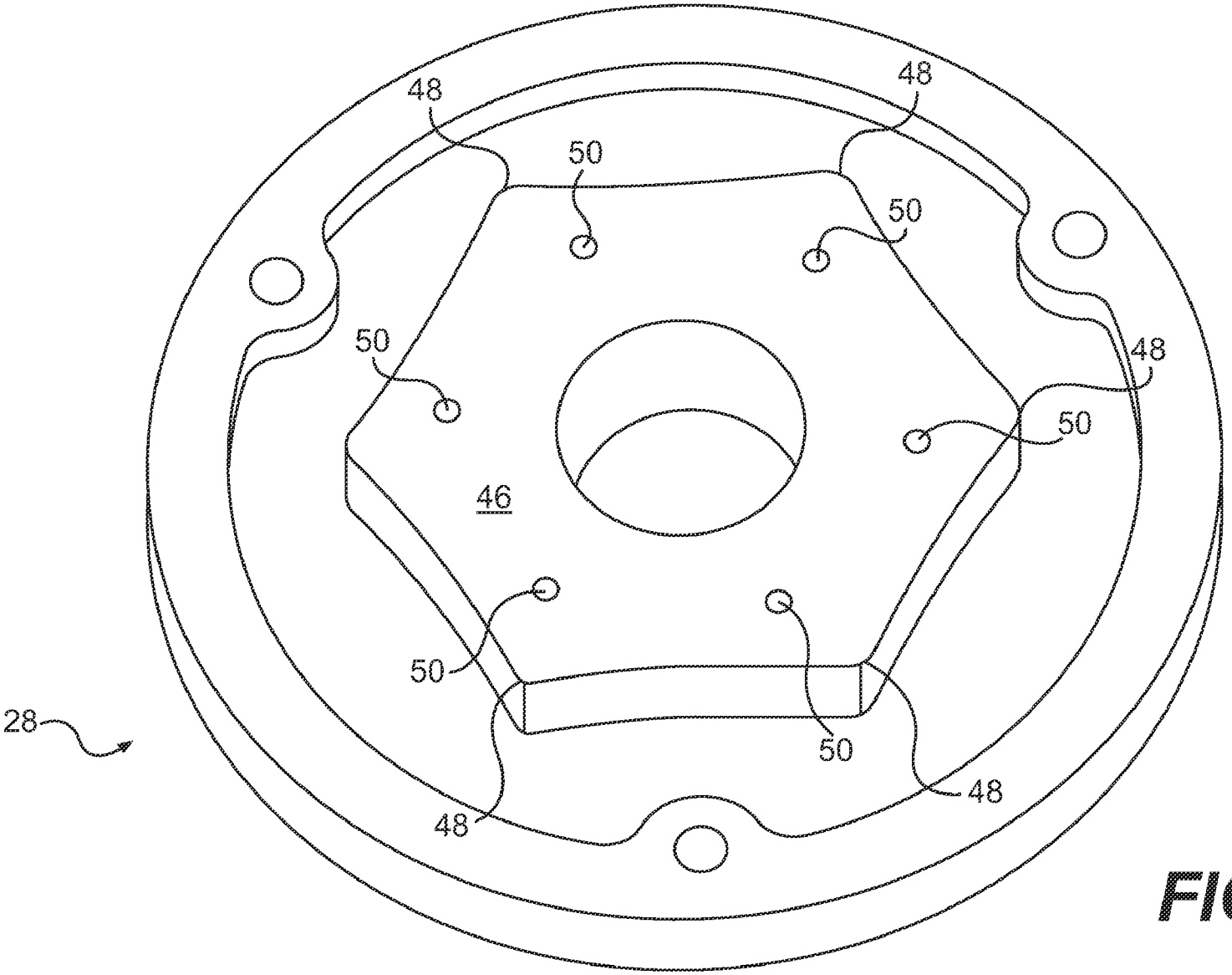
FIG. 5 is a perspective view of an inlet plate for the pump of FIG. 1.
Figure 6:
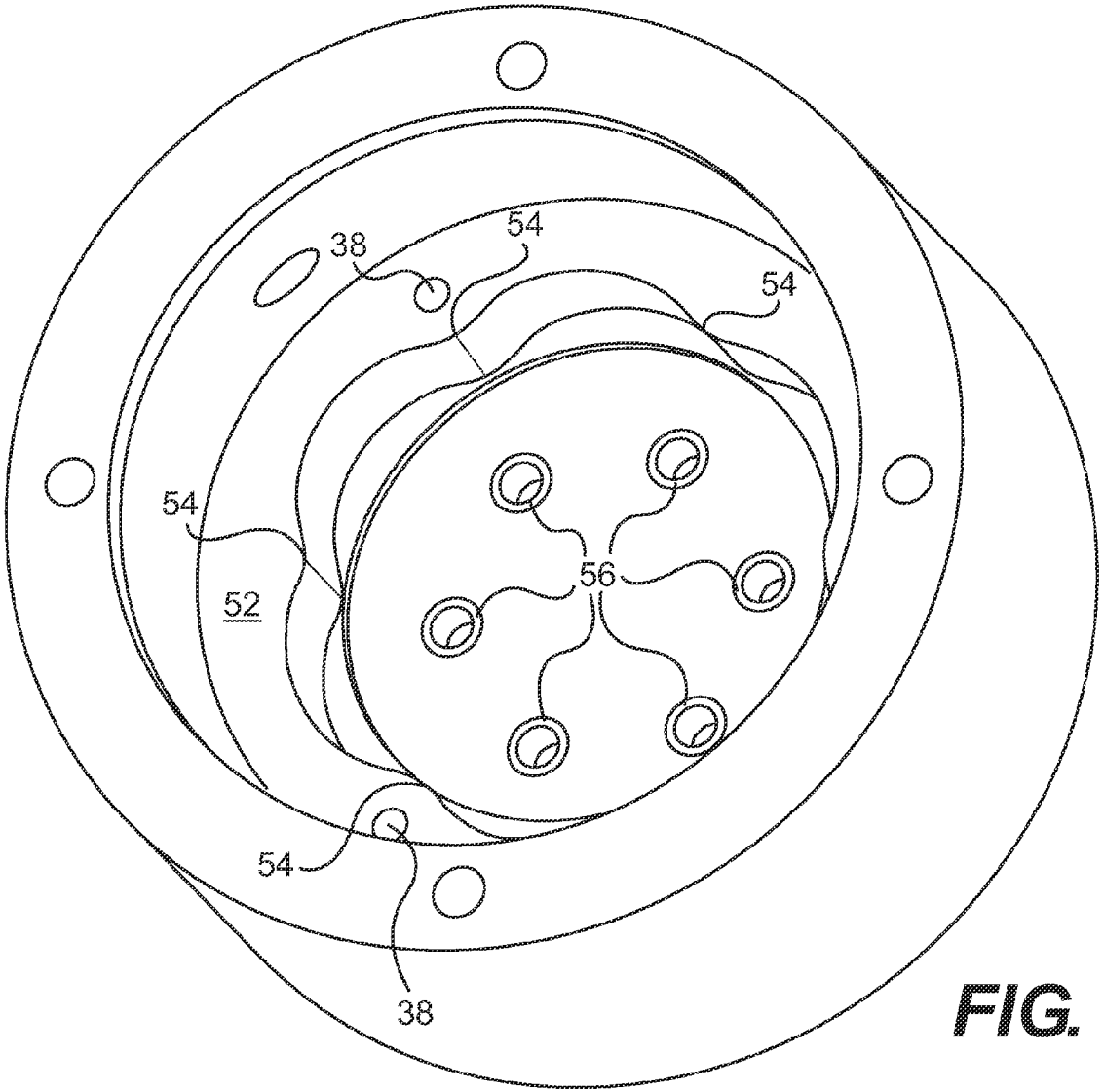
FIG. 6 is a perspective view of a cover for the pump of FIG. 1.

Referring to FIG. 5, the inlet plate 28 includes a hexagonal inlet cam ring 46 including six equally-spaced inlet cam lobes 48. The inlet plate 28 also has six housing inlets 50, the purpose of which will be described below. Referring to FIG. 6, the cover 14 includes an outlet cam ring 52 including six equally-spaced outlet cam lobes 54, four of which are visible in FIG. 6. The cover 14 also has six housing outlets 32, the purpose of which will be described below. Each housing inlet 50 has a corresponding inlet cam lobe 48, and each housing outlet has a corresponding outlet cam lobe 54. It is contemplated that there may be more or fewer housing inlets 50, each with a corresponding inlet cam lobe 48, and an equal number of housing outlets 32, each with a corresponding outlet cam lobe 54. The inlet cam lobes 48 and the outlet cam lobes 54 cause the piston to reciprocate as will be described below in further detail.

Figure 9A:
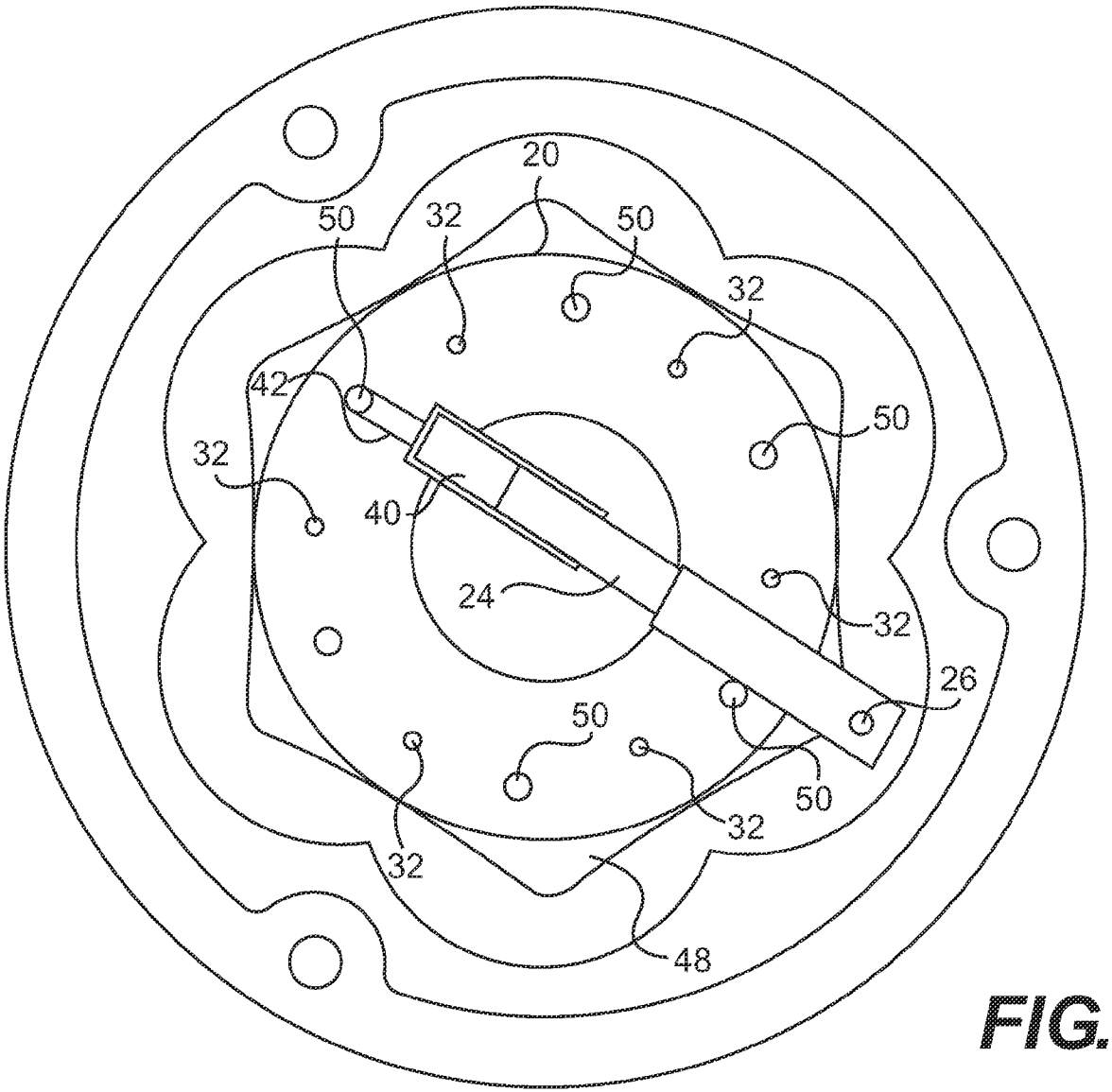
FIGS. 9A and 9B are schematic views of an inlet plate, a rotor and an outlet cam ring for a pump in accordance with the present invention.
Figure 9B:
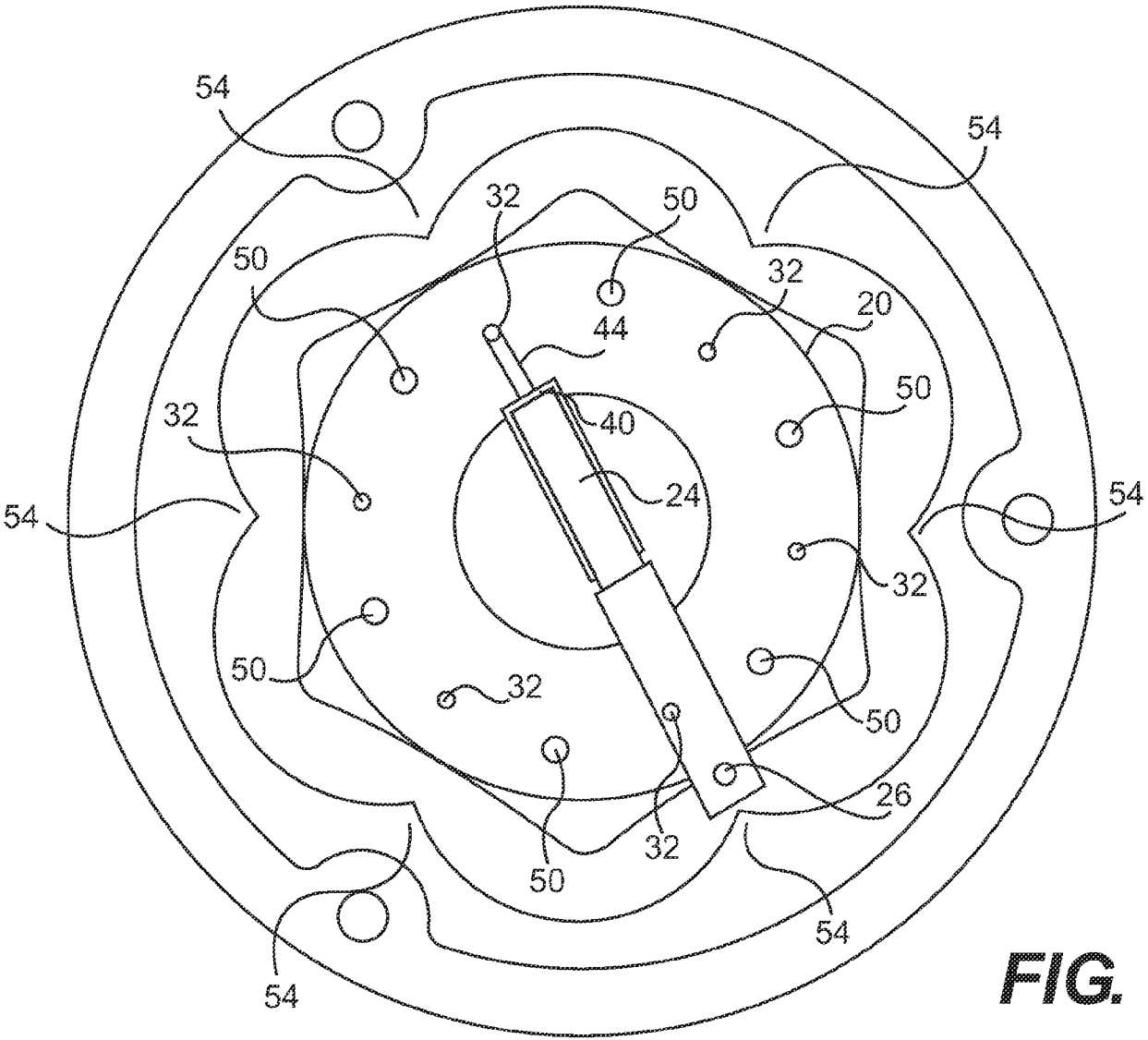

Referring to FIGS. 9A and 9B, the operation of the pump 10 will now be described.

Referring generally to FIGS. 9A and 9B, the cover 14, the rotor 20 and the inlet plate 28 are shown schematically in a superimposed arrangement, as they are oriented when the pump 10 is assembled. As the rotor 20 rotates inside the housing 11, the chamber inlet 42 comes into alignment with each of the housing inlets 50 in turn, providing fluid communication between that housing inlet 50 and the pumping chamber 40. The contact between the rotor 20 and the inlet plate 28 blocks the housing inlets when they are not aligned with the chamber inlet 42, providing fluid isolation between the pumping chamber 40 and the remaining housing inlets 50. Similarly, as the rotor 20 rotates, the chamber outlet 44 comes into alignment with each of the housing outlets 32 in turn, providing fluid communication between that housing outlet 32 and the pumping chamber 40, and providing fluid isolation between the pumping chamber 40 and the remaining housing outlets 32.

In FIG. 9A, the rotor 20 is in a first position wherein the chamber inlet 42 is aligned with a first one of the housing inlets 50. In this position, the pumping chamber 40 is in fluid communication with the first housing inlet 50 and in fluid isolation from the remaining housing inlets 50 and from all of the housing outlets 32. The inlet cam lobes 48 are positioned relative to the housing inlets 50 such that when the rotor 20 is in the first position, one of the inlet cam lobes 48 abuts against the piston follower 26 and urges the piston follower 26 radially outward, thereby moving the piston body 24 to the first position to increase the volume of the pumping chamber 40 as shown in FIG. 9A. The movement of the piston body 24 draws lubricant from the inside of the housing 11 through the housing inlet 50 that is aligned with the chamber inlet 42, into the pumping chamber 40 via the chamber inlet 42.

Referring to FIG. 9B, as the rotor 20 continues to rotate, it enters a second position wherein the chamber outlet 44 is aligned with a first one of the housing outlets 32. In this position, the pumping chamber 40 is in fluid communication with the first housing outlet 32 and in fluid isolation from the remaining housing outlets 32 and from all the housing inlets 50. The outlet cam lobes 54 are positioned relative to the housing outlets 32 such that when the rotor 20 is in the second position, one of the outlet cam lobes 54 abuts against the piston follower 26 and urges the piston follower 26 radially inward, thereby moving the piston body 24 to the second position to decrease the volume of the pumping chamber 40 as shown in FIG. 9B. The movement of the piston body 24 expels lubricant from the pumping chamber 40 out of the housing 11 through the housing outlet 32 that is aligned with the chamber outlet 44, via the chamber outlet 44.

As the rotor 20 continues to rotate, it enters a third position wherein the chamber inlet 42 is aligned with a second one of the housing inlets 50. In this position, the pumping chamber 40 is in fluid communication with the second housing inlet 50 and in fluid isolation from the remaining housing inlets 50 and from all of the housing outlets 32. The inlet cam lobes 48 are positioned relative to the housing inlets 50 such that when the rotor 20 is in the third position, a second one of the inlet cam lobes 48 abuts against the piston follower 26 and urges the piston follower 26 radially outward, thereby moving the piston body 24 to the first position to increase the volume of the pumping chamber 40 as shown in FIG. 9A. The movement of the piston body 24 to the first position draws lubricant from the inside of the housing 11 through the second housing inlet 50 that is aligned with the chamber inlet 42, into the pumping chamber 40 via the chamber inlet 42.

As the rotor 20 continues to rotate, it enters a fourth position wherein the chamber outlet 44 is aligned with a second one of the housing outlets 32. In this position, the pumping chamber 40 is in fluid communication with the second housing outlet 32 and in fluid isolation from the remaining housing outlets 32 and from all of the housing inlets 50. The outlet cam lobes 54 are positioned relative to the housing outlets 32 such that when the rotor 20 is in the fourth position, a second one of the outlet cam lobes 54 abuts against the piston follower 26 and urges the piston follower 26 radially inward, thereby moving the piston body 24 to the second position to decrease the volume of the pumping chamber 40 as shown in FIG. 9B. The movement of the piston body 24 expels lubricant from the pumping chamber 40 out of the housing 11 through the housing outlet 32 that is aligned with the chamber outlet 44, via the chamber outlet 44.

In the event that the pump 10 has more than two housing inlets 50 and more than two housing outlets 32, each of the housing inlets 50 and each of the housing inlets 32 will sequentially come into fluid communication with the pumping chamber 40 as the rotor 20 continues to rotate. In this manner, the piston 22 will sequentially draw lubricant into the pumping chamber 40 from each housing inlet 50, and expel the lubricant out of the pumping chamber 40 via a respective housing outlet 32.

Figure 7A:
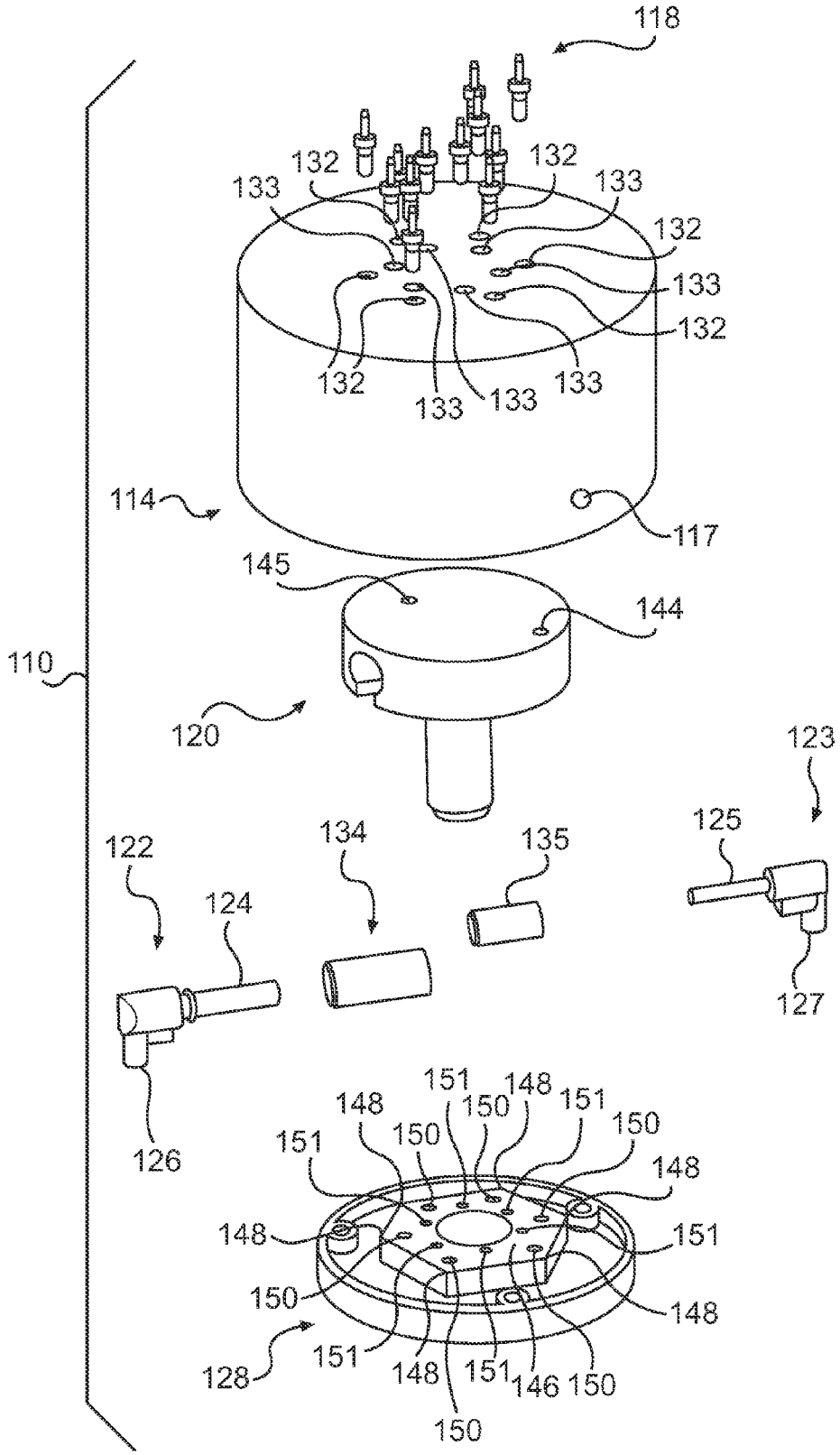
FIG. 7A is a partial exploded view of a pump according to a second embodiment of the present invention.
Figure 7B:
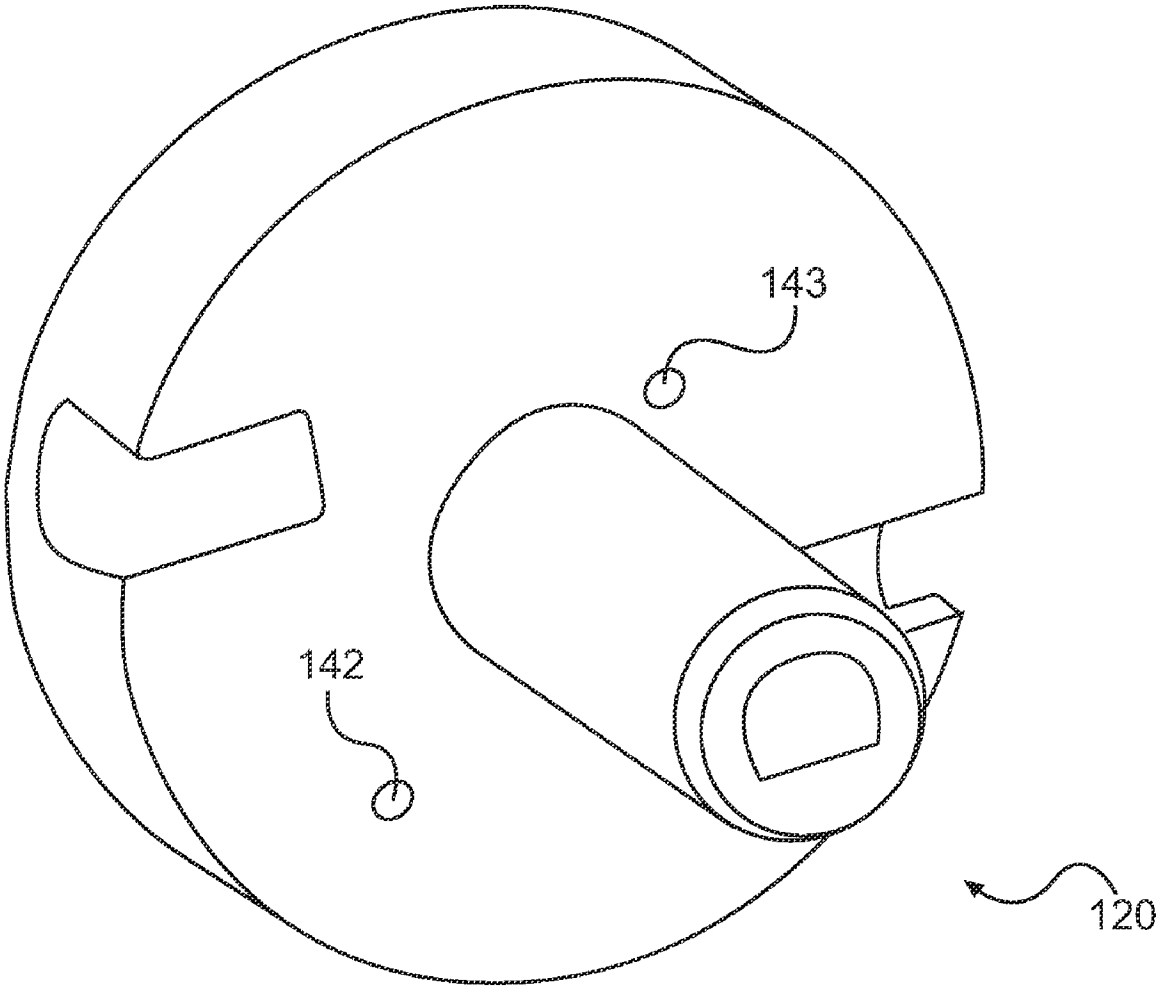
FIG. 7B is a perspective view of a rotor for the pump of FIG. 7A

Referring now to FIGS. 7A and 7B, a pump 110 will be described according to a second embodiment of the invention. A number of components of the pump 10 of FIG. 1, such as the base plate 12, the motor 16, the springs 30 and the pins 36, have corresponding components in the pump 110 that perform a similar function. These components of the pump 110 are not shown in FIG. 7 and will not be discussed in detail.

The pump 110 includes a housing (not shown) composed of a base plate and a cover 114. The pump 110 is driven in the same manner as the pump 10 of FIG. 2. Lubricant (not shown) enters the housing via the aperture 117 and fills the interior of the housing in the same manner as the pump 10 of FIG. 1. The cover 114 has housing outlets 132 and 133 and hose connectors 118 and 119 that function similarly to the housing outlets 32 and hose connectors 18 of FIG. 2. The inlet plate 128 has housing inlets 150 and 151 that function similarly to the housing inlets 150 of FIG. 2. As the rotor 120 rotates within the housing, the respective piston followers 126 and 127 of the pistons 122 and 123 sequentially abut against the inlet cam lobes 148 and the outlet cam lobes 154, causing the piston bodies 124 and 125 to reciprocate in their respective bushings 134 and 135 to pump lubricant respectively through the housing outlets 132 and 133 in the cover 114, similarly to the reciprocation of the pistons 22 of the pump 10 of FIG. 2.

The rotor 120 functions similarly to the rotor 20 of FIG. 2. As the rotor 120 rotates, the pistons 122 and 123 are caused to reciprocate. The piston bodies 124 and 125 reciprocate within the respective bushings 134 and 135 between a first position and a second position (not shown). Each piston body 124, 125 and its respective bushing 134, 135 together define a pumping chamber (not shown).

Each of the pistons 122, 123 is actuated when the inlet cam lobes 148 of the inlet cam ring 146, and the outlet cam lobes (not shown) act on the piston followers 126, 127 as will be described below in further detail. Each of the six inlet cam lobes 148 and each of the six outlet cam lobes actuates both pistons 122 and 123 via the respective piston followers 126 and 127. It is contemplated that each piston 122 and 123 may alternatively be actuated by a separate set of inlet and outlet cam lobes.

In this embodiment, the piston 122 draws lubricant from the housing inlets 150 and expels the lubricant through the housing outlets 132; the piston 123 draws lubricant from the housing inlets 151 and expels the lubricant through the housing outlets 133. It is contemplated that the inlet plate 128 may alternatively have only the housing inlets 150. In this alternative embodiment, the chamber inlets 142 and 143 would be appropriately positioned to align with the housing inlets 150 as the rotor 120 rotates. It is further contemplated that the cover 114 may alternatively have only the housing outlets 132. In this alternative embodiment, the chamber outlets 144 and 145 would be appropriately positioned to align with the housing outlets 132 as the rotor 120 rotates.

It is further contemplated that there may be more or fewer housing inlets 150, 151, more or fewer housing outlets 132, 133, more or fewer inlet cam lobes 148 and more or fewer outlet cam lobes, as long as whenever any piston is actuated by an inlet cam lobe, its corresponding chamber inlet is in alignment with a housing inlet, and whenever any piston is actuated by an outlet cam lobe, its corresponding chamber outlet is in alignment with a housing outlet.

It should be understood that the pump 110 is capable of delivering lubricant to as many as twelve different locations, which can be suitable for a six-cylinder two-stroke engine (not shown). The lubricant output from each of the six housing outlets 132 could be transmitted to a location upstream of each of the intake reed valves (not shown) of the respective pistons, and the lubricant output from each of the six housing outlets 133 could be transmitted to nozzles (not shown) aimed at the six wrist pins (not shown) of the respective pistons (not shown). It is contemplated that the lubricant may instead be transmitted to any other location where lubrication is desired. It is further contemplated that the two pistons 122 and 123 can have different dimensions, such that each piston pumps different volumes of lubricant. In this manner, different locations that require different quantities of lubricant can be supplied accordingly.

The functioning of the pump 110 is similar to the functioning of the pump 10, and will not be described separately in detail.

Figure 8:
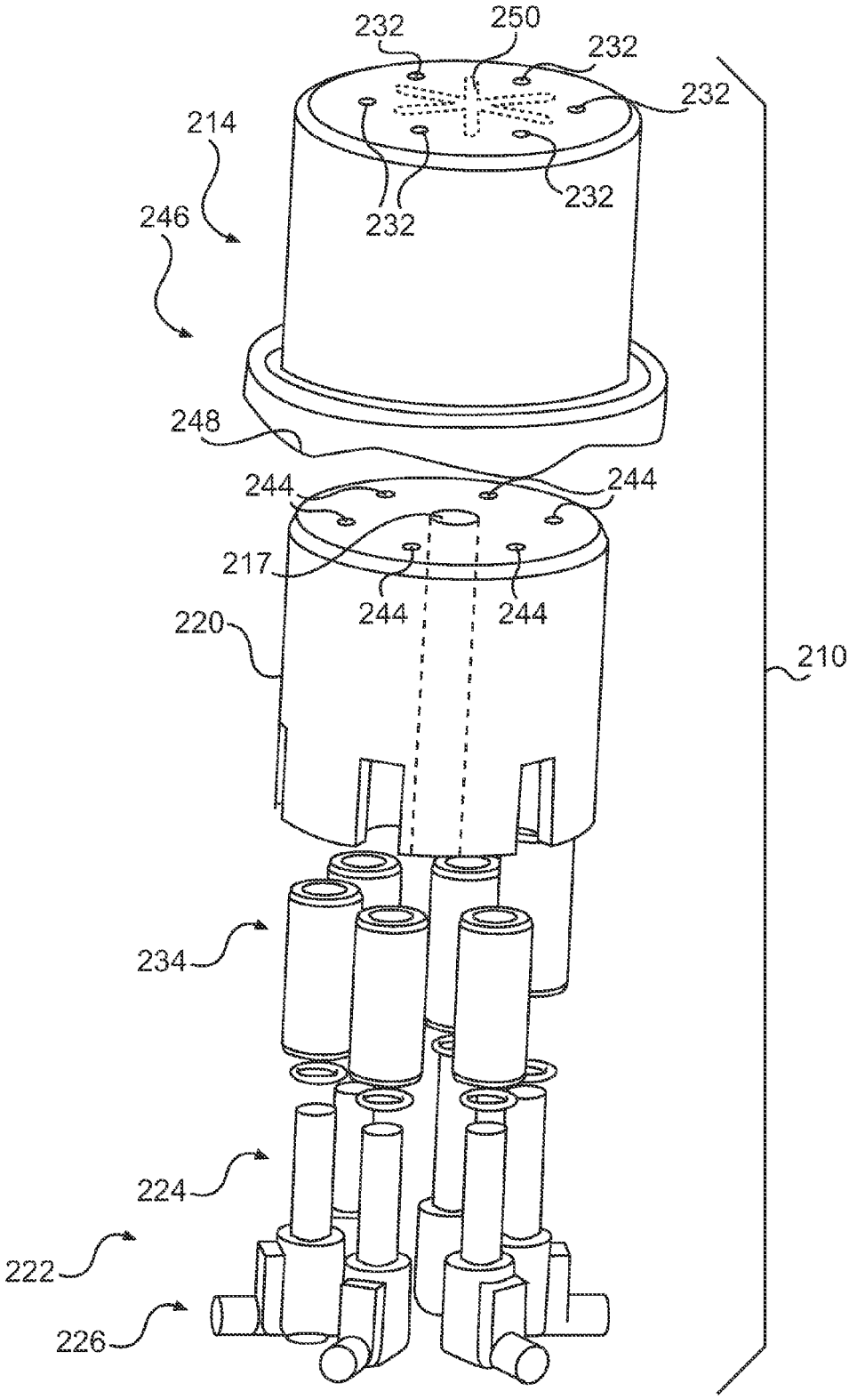
FIG. 8 is a partial exploded view of a pump according to a third embodiment of the present invention.

Referring now to FIG. 8, a pump 210 will be described according to a third embodiment of the invention. A number of components of the pump 10 of FIG. 1, such as the base plate 12, the motor 16, the springs 30 and the pins 36, have corresponding components in the pump 210 that perform a similar function. These components of the pump 210 are not shown in FIG. 7 and will not be discussed in detail.

The pump 210 includes a housing (not shown) composed of a base plate (not shown) and a cover 214. The pump 210 is driven in the same manner as the pump 10 of FIG. 2. Lubricant (not shown) enters the housing via an axial channel 217 in the rotor 220 and fills the six housing inlet channels 250 on the inside of the cover 214. The cover 214 has housing outlets 232 that function similarly to the housing outlets 32 of FIG. 2. The rotor 220 functions similarly to the rotor 20 of FIG. 2. As the rotor 220 rotates within the housing, the respective piston followers 226 of the pistons 222 sequentially abut against the inlet cam lobes 248 and the outlet cam lobes (not shown), causing the piston bodies 224 to reciprocate in their respective bushings 234. The piston bodies 224 reciprocate between a first position and a second position (not shown). Each piston body 224 and its respective bushing 234 together define a pumping chamber (not shown). The reciprocation of the piston bodies 224 draws lubricant from the respective housing inlet channels 250 into the respective pumping chambers (not shown) via the chamber inlets 244. The reciprocation of the piston bodies then pumps the lubricant out of the respective pumping chambers via the chamber inlets 244, which also function as chamber outlets, through the respective housing outlets 232 in the cover 214. In this embodiment, the pistons 222 reciprocate in an axial direction, parallel to the axis of rotation of the rotor 220.

Each of the pistons 222 is actuated when the inlet cam lobes 248 of the inlet cam ring 246, and the outlet cam lobes (not shown) act on the piston followers 226. Each of the six inlet cam lobes 248 and each of the six outlet cam lobes actuates each of the pistons 222 via the respective piston followers 226.

In this embodiment, each piston 222 draws lubricant from the housing inlets 250 and expels the lubricant through the housing outlets 232. It is contemplated that there may be more or fewer housing inlets 250, more or fewer housing outlets 232, more or fewer inlet cam lobes 248 and more or fewer outlet cam lobes, as long as whenever any piston is actuated by an inlet cam lobe, its corresponding chamber inlet is in alignment with a housing inlet, and whenever any piston is actuated by an outlet cam lobe, its corresponding chamber outlet is in alignment with a housing outlet.

The functioning of the pump 210 is similar to the functioning of the pump 10, and will not be described separately in detail.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A piston pump, comprising:

a housing;

a rotor assembly rotatably disposed in the housing, the rotor assembly comprising:

a rotor;

a pumping chamber disposed in the rotor;

a piston slidably disposed within the pumping chamber and movable between a first position and a second position therein;

the housing comprising:

a first housing inlet and a second housing inlet selectively fluidly communicating with the pumping chamber;

a first housing outlet and a second housing outlet selectively fluidly communicating with the pumping chamber;

an inlet cam assembly fixedly disposed in the housing, the inlet cam assembly having first and second inlet cam lobes operative to move the piston to the first position; and an outlet cam assembly fixedly disposed in the housing, the outlet cam assembly having first and second outlet cam lobes operative to move the piston to the second position;

the rotor being rotatable sequentially between first, second, third and fourth positions relative to the housing, wherein when the rotor is in the first position, the pumping chamber is in fluid communication with the first housing inlet and in fluid isolation from the second housing inlet and from the first and second housing outlets; and the first inlet cam lobe urges the piston toward the first position to draw fluid into the pumping chamber via the first housing inlet;

wherein when the rotor is in the second position, the pumping chamber is in fluid communication with the first housing outlet and in fluid isolation from the first and second housing inlets and from the second housing outlet; and the first outlet cam lobe urges the piston to the second position to expel fluid out of the pumping chamber via the first housing outlet;

wherein when the rotor is in the third position, the pumping chamber is in fluid communication with the second housing inlet and in fluid isolation from the first housing inlet and from the first and second housing outlets; and the second inlet cam lobe urges the piston toward the first position to draw fluid into the pumping chamber via the second housing inlet; and wherein when the rotor is in the fourth position, the pumping chamber is in fluid communication with the second housing outlet and in fluid isolation from the first housing outlet and the first and second housing inlets; and the second outlet cam lobe urges the piston to the second position to expel fluid out of the pumping chamber via the second housing outlet.

2. The piston pump of claim 1, wherein the housing is generally symmetric about a central longitudinal axis of symmetry.

3. The piston pump of claim 2, wherein the rotor is rotatable about the central longitudinal axis of symmetry.

4. The piston pump of claim 3, wherein:

the inlet cam assembly is centered about the central longitudinal axis of symmetry.

5. The piston pump of claim 4, wherein:

the outlet cam assembly is centered about the central longitudinal axis of symmetry.

6. The piston pump of claim 1, wherein:

the housing further comprises a third housing inlet selectively fluidly communicating with the pumping chamber and a third housing outlet selectively fluidly communicating with the pumping chamber;

the inlet cam assembly further comprises a third inlet cam lobe;

the outlet cam assembly further comprises a third outlet cam lobe; and when the rotor is in the first, second third and fourth positions, the pumping chamber is in fluid isolation from the third housing inlet and the third housing outlet;

the rotor being further rotatable between fifth and sixth positions relative to the housing, wherein when the rotor is in the fifth position, the pumping chamber is in fluid communication with the third housing inlet and in fluid isolation from the first and second housing inlets and from the first, second and third housing outlets; and the third inlet cam lobe urges the piston toward the first position to draw fluid into the pumping chamber via the third housing inlet;

wherein when the rotor is in the sixth position, the pumping chamber is in fluid communication with the third housing outlet and in fluid isolation from the first, second and third housing inlets and from the first and second housing outlets; and the third outlet cam lobe urges the piston to the second position to expel fluid out of the pumping chamber via the third housing outlet.

7. The piston pump of claim 1, wherein:

the pumping chamber is a first pumping chamber;

the piston is a first piston;

the chamber inlet is a first chamber inlet;

the chamber outlet is a first chamber outlet;

the rotor further comprising:

a second pumping chamber disposed in the rotor;

a second piston slidably disposed within the second pumping chamber and movable between a first position and a second position therein;

the housing further comprising:

a third housing inlet and a fourth housing inlet selectively fluidly communicating with the second pumping chamber;

a third housing outlet and a fourth housing outlet selectively fluidly communicating with the second pumping chamber;

the rotor being further rotatable between fifth, sixth, seventh and eighth positions relative to the housing;

wherein when the rotor is in the fifth position, the second pumping chamber is in fluid communication with the third housing inlet and in fluid isolation from the fourth housing inlet and from the third and fourth housing outlets; and the first inlet cam lobe urges the second piston toward the first position to draw fluid into the second pumping chamber via the third housing inlet;

wherein when the rotor is in the sixth position, the second pumping chamber is in fluid communication with the third housing outlet and in fluid isolation from the third and fourth housing inlets and from the fourth housing outlet; and the first outlet cam lobe urges the second piston to the second position to expel fluid out of the second pumping chamber via the third housing outlet;

wherein when the rotor is in the seventh position, the second pumping chamber is in fluid communication with the fourth housing inlet and in fluid isolation from the third housing inlet and from the third and fourth housing outlets; and the second inlet cam lobe urges the second piston toward the first position to draw fluid into the second pumping chamber via the fourth housing inlet; and wherein when the rotor is in the eighth position, the second pumping chamber is in fluid communication with the fourth housing outlet and in fluid isolation from the third housing outlet and the third and fourth housing inlets; and the second outlet cam lobe urges the second piston to the second position to expel fluid out of the second pumping chamber via the fourth housing outlet.

8. The piston pump of claim 7, wherein:

the third housing inlet is the first housing inlet; and the fourth housing inlet is the second housing inlet.

9. The piston pump of claim 7, wherein:

the fifth position is the first position;

the sixth position is the second position;

the seventh position is the third position; and the eighth position is the fourth position.

10. A method of distributing fluid via a pump having:

a housing;

a rotor rotatably disposed within the housing;

the rotor having:

a pumping chamber disposed therein; and a piston slidably disposed within the pumping chamber;

the housing having:

a first housing inlet and a second housing inlet selectively fluidly communicating with the pumping chamber, and a first housing outlet and a second housing outlet selectively fluidly communicating with the pumping chamber;

an inlet cam assembly fixedly disposed in the housing, the inlet cam assembly having first and second inlet cam lobes; and an outlet cam assembly fixedly disposed in the housing, the outlet cam assembly having first and second outlet cam lobes;

the method comprising:

rotating the rotor to a first position providing:

fluid communication between the pumping chamber and the first housing inlet;

fluid isolation between the pumping chamber and the second housing inlet;

fluid isolation between the pumping chamber and the first and second housing outlets; and actuation of the piston by the first inlet cam lobe to draw fluid into the pumping chamber via the first housing inlet;

rotating the rotor to a second position providing:

fluid communication between the pumping chamber and the first housing outlet;

fluid isolation between the pumping chamber and the second housing outlet;

fluid isolation between the pumping chamber and the first and second housing inlets; and actuation of the piston by the first outlet cam lobe to expel fluid out of the pumping chamber via the first housing outlet;

rotating the rotor to a third position providing:

fluid communication between the pumping chamber and the second housing inlet;

fluid isolation between the pumping chamber and the first housing inlet;

fluid isolation between the pumping chamber and the first and second housing outlets; and actuation of the piston by the second inlet cam lobe to draw fluid into the pumping chamber via the second housing inlet; and rotating the rotor to a fourth position providing:

fluid communication between the pumping chamber and the second housing outlet;

fluid isolation between the pumping chamber and the first housing outlet;

fluid isolation between the pumping chamber and the first and second housing inlets; and actuation of the piston by the second outlet cam lobe to expel fluid out of the pumping chamber via the first housing outlet.

11. The method of claim 10, wherein:

the housing is generally symmetric about a central longitudinal axis of symmetry; and rotating the rotor comprises rotating the rotor about an axis coaxial with the central longitudinal axis of symmetry.

12. The method of claim 10, wherein the housing further comprises a third housing inlet selectively fluidly communicating with the pumping chamber and a third housing outlet selectively fluidly communicating with the pumping chamber;

the inlet cam assembly further comprises a third inlet cam lobe; and the outlet cam assembly further comprises a third outlet cam lobe;

rotating the rotor to any of the first, second, third and fourth positions further providing fluid isolation from the third housing inlet and the third housing outlet;

the method further comprising:

rotating the rotor to a fifth position providing:

fluid communication between the pumping chamber and the third housing inlet;

fluid isolation between the pumping chamber and the first and second housing inlets;

fluid isolation between the pumping chamber and the first, second and third housing outlets; and actuation of the piston by the third inlet cam lobe to draw fluid into the pumping chamber via the third housing inlet; and rotating the rotor to a sixth position providing:

fluid communication between the pumping chamber and the third housing outlet;

fluid isolation between the pumping chamber and the first and second housing outlet;

fluid isolation between the pumping chamber and the first, second and third housing inlets; and actuation of the piston by the third outlet cam lobe to expel fluid out of the pumping chamber via the third housing outlet.

13. The method of claim 10, wherein:

the pumping chamber is a first pumping chamber;

the piston is a first piston;

the chamber inlet is a first chamber inlet;

the chamber outlet is a first chamber outlet;

the rotor further comprising:

a second pumping chamber disposed therein;

a second piston slidably disposed within the second pumping chamber;

the housing further comprising:

a third housing inlet and a fourth housing inlet selectively fluidly communicating with the second pumping chamber;

a third housing outlet and a fourth housing outlet selectively fluidly communicating with the second pumping chamber;

the method further comprising:

rotating the rotor to a fifth position providing:

fluid communication between the second pumping chamber and the third housing inlet;

fluid isolation between the second pumping chamber and the fourth housing inlet;

fluid isolation between the second pumping chamber and the third and fourth housing outlets; and actuation of the second piston to draw fluid into the second pumping chamber via the third housing inlet;

rotating the rotor to a sixth position providing:

fluid communication between the second pumping chamber and the third housing outlet;

fluid isolation between the second pumping chamber and the third and fourth housing inlets;

fluid isolation between the second pumping chamber and the fourth housing outlet; and actuation of the second piston to expel fluid out of the second pumping chamber via the third housing outlet;

rotating the rotor to a seventh position providing:

fluid communication between the second pumping chamber and the fourth housing inlet;

fluid isolation between the second pumping chamber and the third housing inlet;

fluid isolation between the second pumping chamber and the third and fourth housing outlets; and actuation of the second piston to draw fluid into the second pumping chamber via the fourth housing inlet; and rotating the rotor to an eighth position providing:

fluid communication between the second pumping chamber and the fourth housing outlet;

fluid isolation between the second pumping chamber and the third housing outlet;

fluid isolation between the second pumping chamber and the third and fourth housing inlets; and actuation of the second piston to expel fluid out of the second pumping chamber via the fourth housing outlet.

* * * * *